US005898814A

United States Patent [19]

Yamamoto

[11] Patent Number: 5,898,814

[45] Date of Patent: Apr. 27, 1999

[54] ANTI-SKID STAIR COVERING WITH ILLUMINATING AREAS THEREIN

[76] Inventor: Isao Yamamoto, 11-62, 3-Chome, Ohgata, Kashiwara-shi, Osaka, Japan

[21] Appl. No.: 08/934,942

[22] Filed: Sep. 22, 1997

[30] Foreign Application Priority Data

Feb. 27, 1997 [JP] Japan ..... 9-062549

[51] Int. Cl.[6] ..... G02B 6/00

[52] U.S. Cl. ..... 385/147; 362/32

[58] Field of Search ..... 385/147, 900, 385/901, 902; 362/32, 146, 152

[56] References Cited

U.S. PATENT DOCUMENTS

| | | | |
|---|---|---|---|
| 3,871,747 | 3/1975 | Andrews | 385/147 |
| 3,940,865 | 3/1976 | Mori | 40/134 |
| 4,612,606 | 9/1986 | Roberts | 362/146 |
| 5,067,062 | 11/1991 | Rulke | 362/146 |
| 5,339,228 | 8/1994 | Baethge et al. | 362/146 |
| 5,613,758 | 3/1997 | Kamschal et al. | 362/146 |

*Primary Examiner*—Akm E. Ullah
*Attorney, Agent, or Firm*—Moonray Kojima

[57] ABSTRACT

In order to ascend and descend the stairs safely even in the nighttime, the invention presents a stairs antiskid member capable of reducing the thickness of the entire antiskid member, enhancing the visual recognition of stairs by light, and assuring sufficient safety when ascending and descending stairs, by accommodating and holding an illuminating plane in a stair antiskid member having an illuminating function, forming a permeable light transmitting portion at least in the front edge of front, rear and side edges, except the middle portion of the member upper surface, and forming a reflecting portion for radiating the light from the illuminating plane through the light transmitting portion at the luminous side of the illuminating plane.

7 Claims, 6 Drawing Sheets

ANTI-SKID STAIR COVERING WITH ILLUMINATING AREAS THEREIN

BACKGROUND OF THE INVENTION

1. Field of the Invention

The present invention relates to a stairs antiskid member having an illuminating function so as to ascend and descend stairs safely even in the nighttime. Herein, stairs include any stepped position regardless of the number of stairs.

2. Description of the Prior Art

In the stairs antiskid member having an illuminating function, hitherto, a lamp contained a thin tube or a light-emitting diode is disposed as light source in the upper portion of an angle-shaped frame member as the base, and transparent antiskid members are buried from above the light source.

In such conventional stairs antiskid members, since the lamp or light-emitting diode is used as the light source, the thickness of the entire stairs antiskid member is increased.

SUMMARY OF THE INVENTION

It is hence a primary object of the invention to present a stairs antiskid member capable of reducing the thickness of the entire antiskid member, enhancing the visual recognition of stairs by light, and assuring sufficient safety when ascending and descending stairs, by accommodating an illuminating plane in an antiskid member, forming a permeable light transmitting portion at least in the front edge of front, rear and side edges, except the middle portion of the member upper surface, and forming a reflecting portion for radiating the light from the illuminating plane through the light transmitting portion at the luminous side of the illuminating plane.

It is other object of the invention to present a stairs antiskid member capable of further enhancing the visual recognition of stairs and safety when ascending and descending stairs by two beams of light, by forming light transmitting portions in two side edges before and after the antiskid member.

It is a different object of the invention to present a stairs antiskid member capable of achieving both reduction of internal loss of light from the illuminating plane and assurance of favorable illuminating state by the light guide effect, by forming the reflecting portion by using permeable material, and setting the reflecting portion in a light guide layer.

It is a further object of the invention to present a stairs antiskid member capable of assuring a further favorable illuminating state, by forming the reflecting plane for directing the light from the illuminating plane to the light transmitting portion side, in the reflecting portion.

It is a further different object of the invention to present a stairs antiskid member capable of exhibiting an antiskid effect by a antiskid portion in the upper intermediate portion of the antiskid member, while achieving the above objects at the same time, and protecting the illuminating plane against the load from above by a reflecting member made of a soft synthetic resin.

Other objects of the invention will be better understood from the following detailed description of embodiments.

DESCRIPTION OF THE PREFERRED EMBODIMENTS

Figure 1:
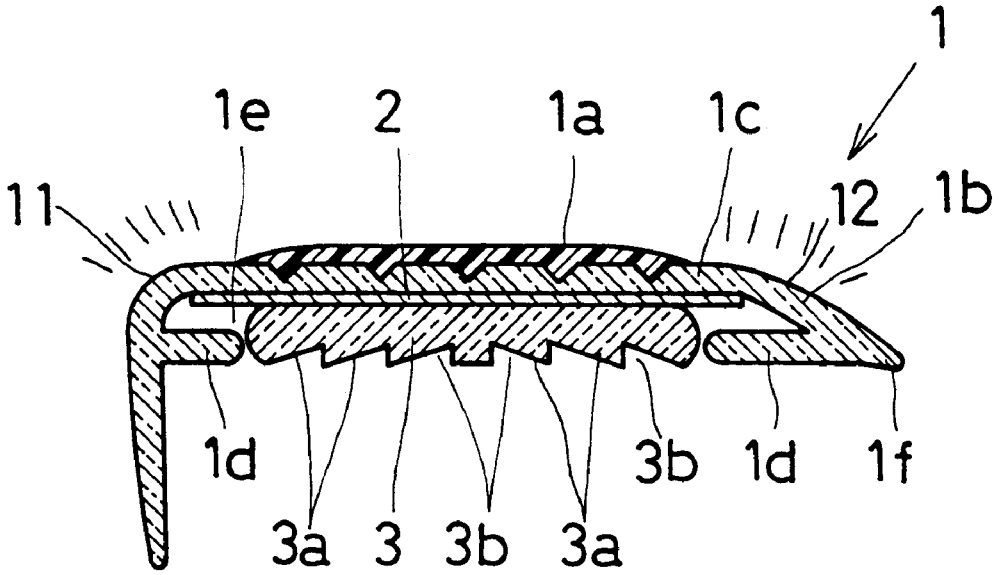
FIG. 1 is a sectional view showing a stairs antiskid member of the invention.

An embodiment of the invention is described in detail below while referring to the drawings.

The drawings relate to a stairs antiskid member, and in FIG. 1, for example, the stairs antiskid member 11 suited to be used in stairs of general household is constituted so that the both side edges at the front and rear can emit light.

Figure 2:
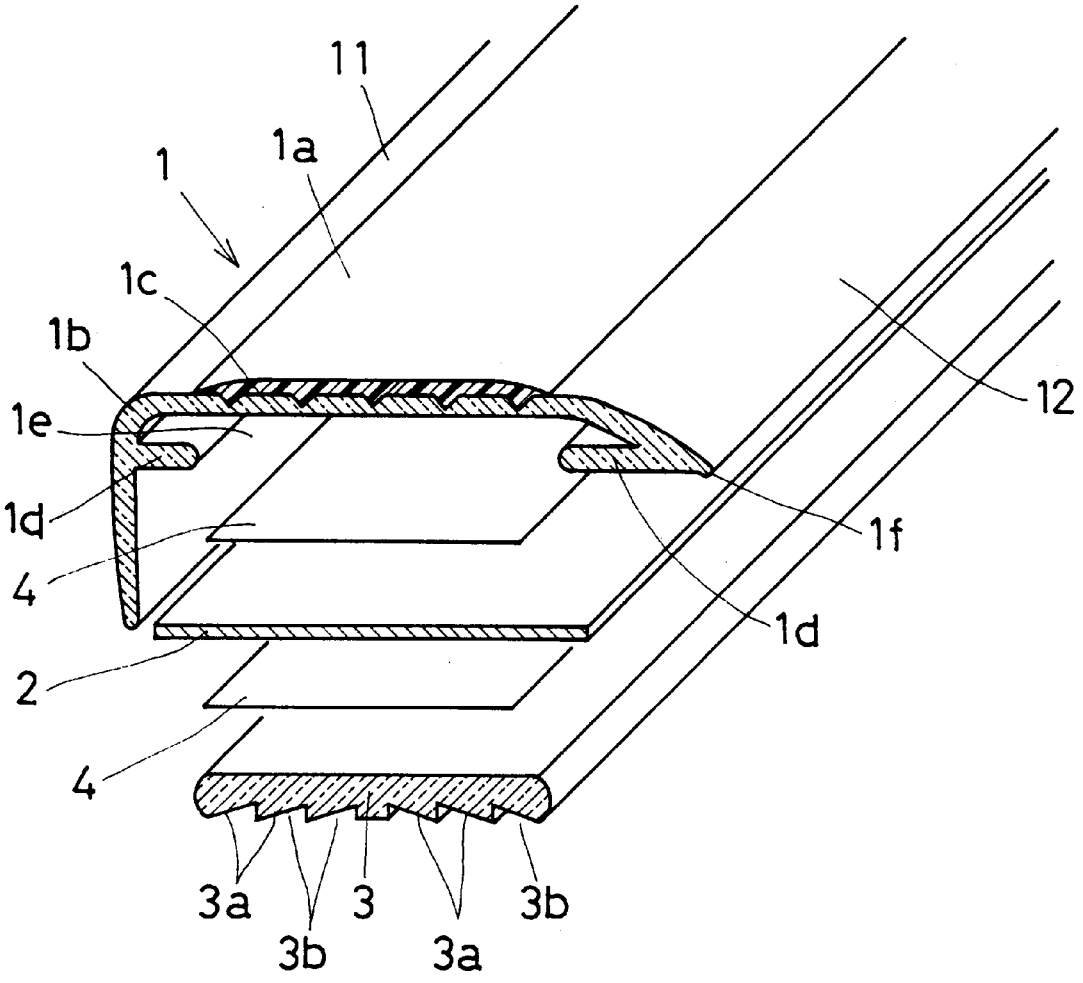
FIG. 2 is a perspective exploded view of the same antiskid member.
Figure 3:
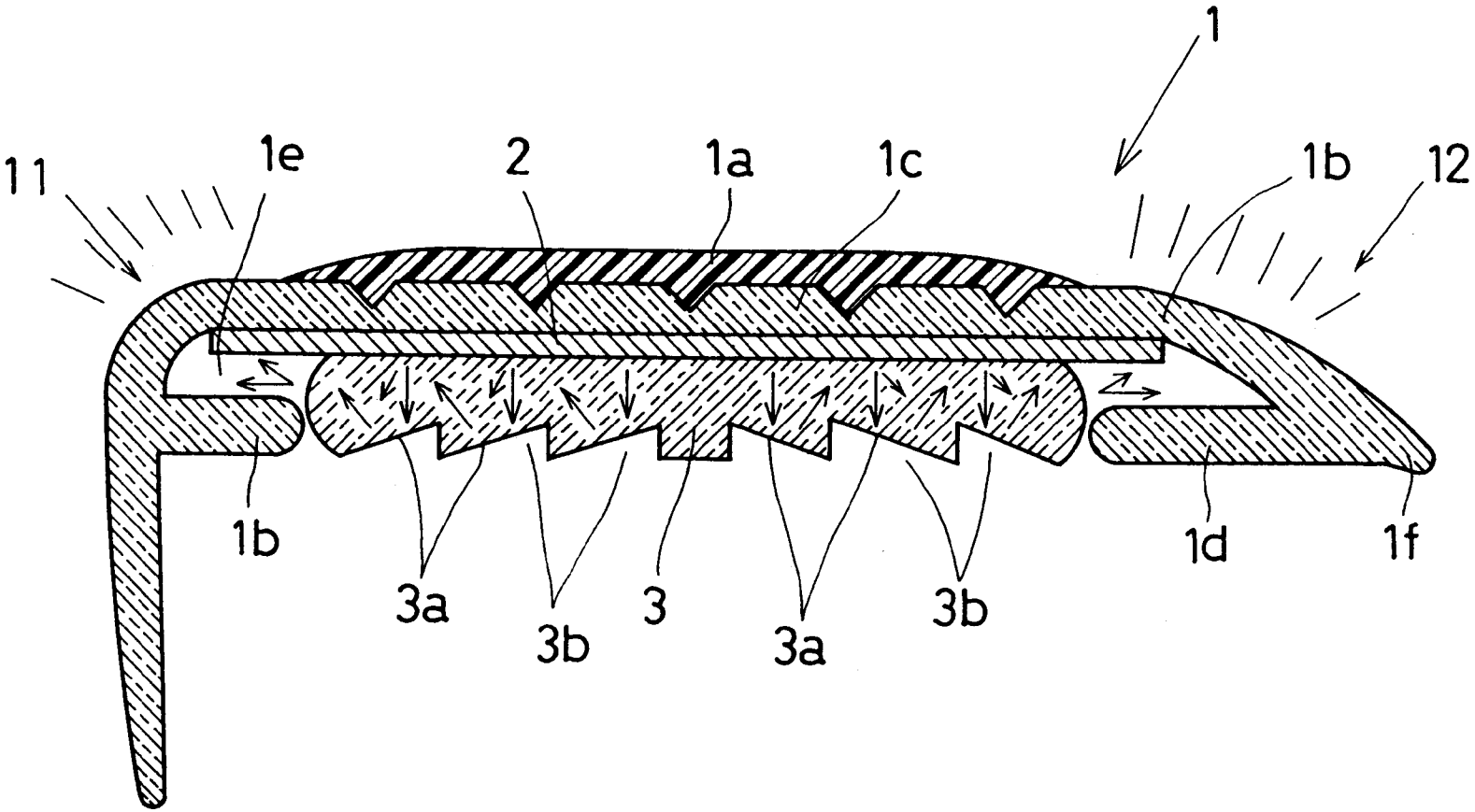
FIG. 3 is an explanatory diagram of light emitting state.

This antiskid member 1 is a long and narrow strip as shown in FIG. 1 through FIG. 5, and a slender illuminating plane 2 (electroluminescence) and a reflecting member 3 are accommodated in its inside (see FIG. 2).

The antiskid member 1 is formed by simultaneous extrusion of two kinds of synthetic resin, and its section is a nearly L-form corresponding to an outer end A (see FIGS. 4, 5) of the tread surface of the stairs, and a stopping portion 1*a* is formed in the middle portion in the longitudinal direction of the top surface (lateral direction in FIG. 1).

The stopping portion 1*a* is formed of a compound material mixing wood chips into soft polyvinyl chloride, and other portion (main body portion 1*b*) is formed of a hard transparent polyvinyl chloride resin.

Herein, the stopping portion 1*a* may be formed in a wood grain pattern to be matched in appearance with the tread surface of the stairs, or may be formed of a resin of a proper color.

In the main body 1*b*, abutting pieces 1*d* contacting flatly with the outer end A are formed integrally at both sides before and after beneath the top surface 1*c* having the stopping portion 1*a*, and the upward portion between these abutting pieces 1*d* is set in an accommodating portion 1*e*. The main body portion 1*b* may not be transparent, but may be enough if light permeable, such as translucent and milky white.

Beneath the rear edge of the main body portion 1*b* of the antiskid member 1 is disposed a slightly inclined folded portion 1*f*, so that dust and dirt may not get into the member. The front edge (left side in the drawing) from the stopping portion 1*a* of the main body portion 1*b*, and the rear edge (right side in the drawing) from the stopping portion 1*a* are set in light transmitting portions 11, 12.

Alternatively, after forming the stopping portion 1*a* separately in the main body portion 1*b*, the both portions 1*b*, 1*a* may be joined, or only the light transmitting portions 11, 12 may be formed of a transparent resin.

The illuminating plane 2 is preferred to be a small piece measuring, for example, about 0.5 mm in thickness and about 18 mm in width. In this case, in the main body portion 1*b* of the anti-skid member 1, by setting its thickness at about 1 mm and the bulge of the stopping portion 1*a* at about 0.5 mm, if the distance of the top surface 1*c* and abutting pieces 1*d* of the main body portion 1*b* is set at slightly larger than 1 mm, the bulge from the tread surface when mounting the antiskid member 1 may be set within about 3 mm. Since this illuminating plane 2 emits light only from one side, the luminous side is set downward so as to emit light to the lower side.

The reflecting member 3 is made of a transparent soft resin such as vinyl chloride, and is formed in a band in a width corresponding to the interval of the abutting pieces id of the antiskid member 1. In both side edges in the width direction of the reflecting member 3, portions engaging with the abutting pieces 1*d* may be formed, but without forming the engaging portions, a sufficient fixed state may be obtained in the method described below.

The reflecting member 3 is made of a soft resin in order to support the load from above with elasticity and alleviate the load on the illuminating plane 2. The reflecting member 3 can be set in a thickness of about 2 mm according to the example of the dimensions presented above, and the inside of the reflecting member 3 is set in a light guide layer for guiding the light.

At the lower side of the reflecting member 3, a reflecting plane 3*a* is formed in order to deflect and reflect the light from the illuminating plane 2, and radiate the light from the light transmitting portions 11, 12 at both side edges before and after. That is, notches 3*b* in right triangular form are formed in a proper number so as to form a reflecting plane 3*a* inclined toward the front side at the front side (left side in FIG. 1) of the middle in the width direction of the reflecting member 3, and to form a reflecting plane 3*a* inclined toward the rear side, at the rear side (see FIG. 3). The reflecting plane 3*a* may be in an appropriate shape such as curved surface, but when formed as described above, the light from the illuminating plane 2 can be sufficiently deflected and reflected in the spreading direction, so that the illuminating manner may be excellent. Incidentally, the reflecting plane 3*a* may be formed not only in the lower surface but also in the upper surface, or may not be formed in the upper surface or in neither surface, and moreover by forming an evaporated aluminum layer on one side of the reflecting member 3, the intensity of the reflected light may be enhanced.

When accommodating with the luminous side of the illuminating plane 2 upward, the reflecting member 3 is stored at the upper surface side of the illuminating plane 2.

The illuminating plane 2 and reflecting member 3 are integrally adhered to the antiskid member 1 by a transparent both-side adhesive tape 4 as shown in FIG. 2.

Figure 4:
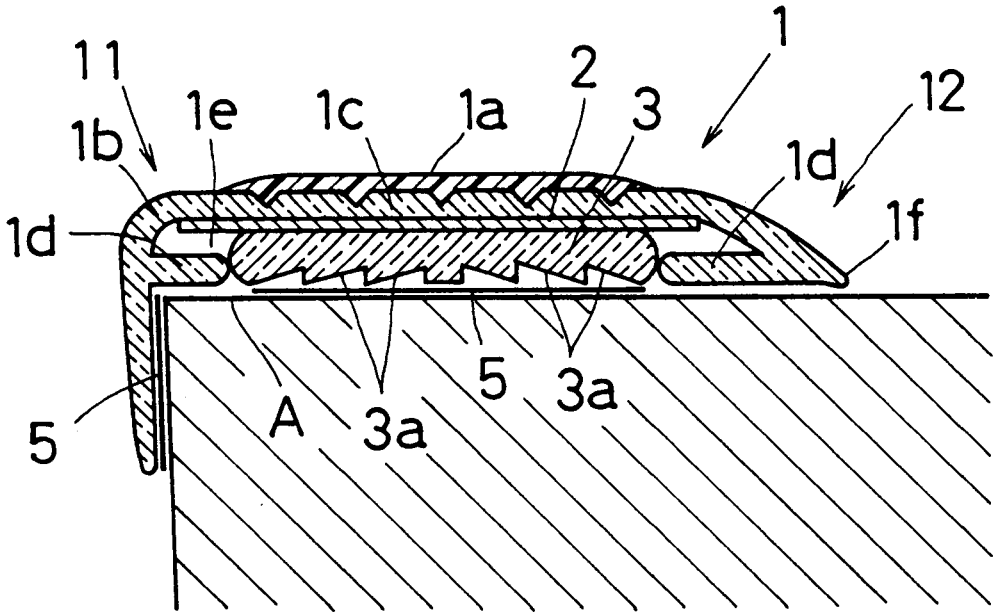
FIG. 4 is a sectional view in the state of use of stairs antiskid member of the invention.

To fix the antiskid member 1 to the outer end A of the tread surface of the stairs, as shown in FIG. 4, it is fixed directly by adhering a both-side adhesive tape 5 to the inner side of the front end of the main body portion 1*b* of the antiskid member 1, and the lower side of the reflecting member 3 integrated to the antiskid member 1. If necessary, a both-side adhesive tape may be also adhered to the lower surface of the abutting piece 1*d* at the rear side of the main body portion 1*b* of the antiskid member 1.

Figure 5:
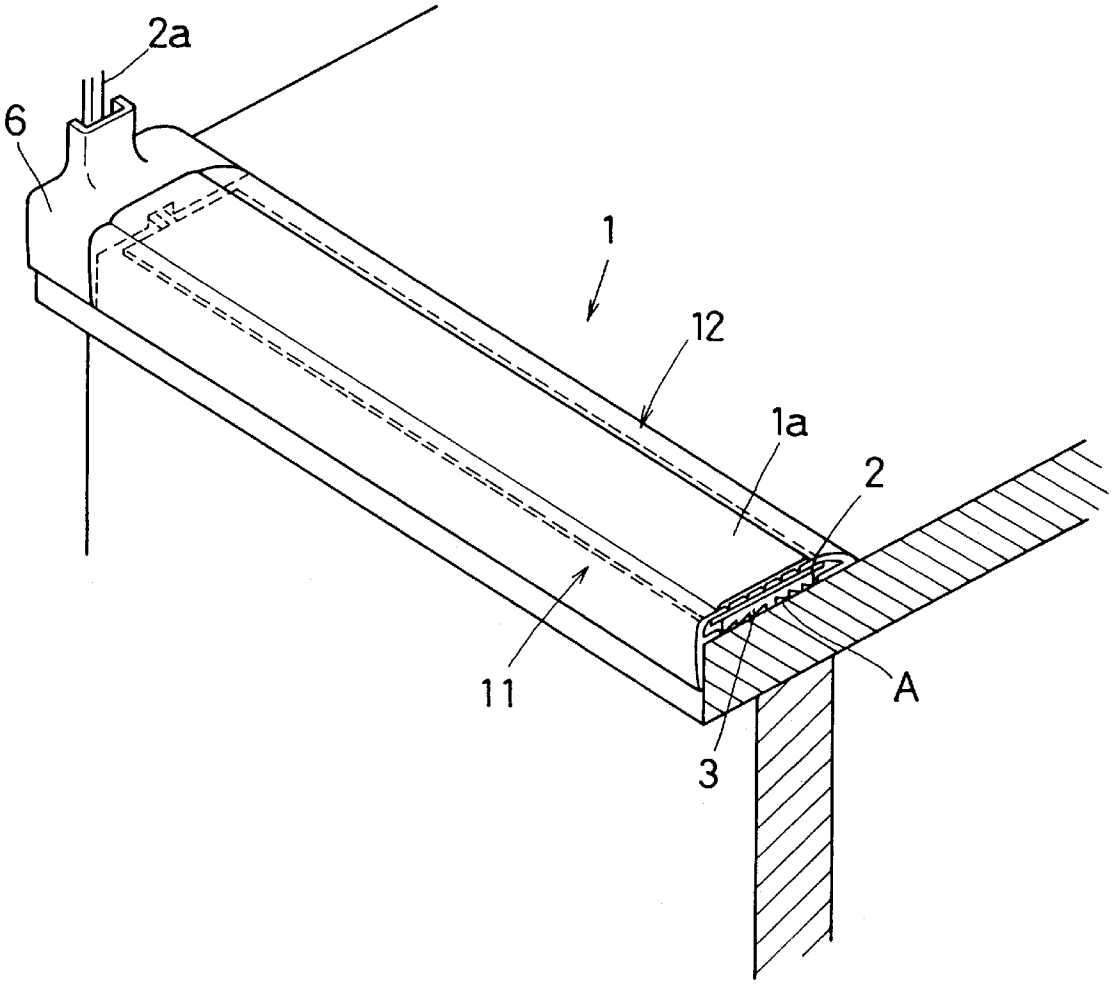
FIG. 5 is a perspective view in the state of use.

A cord 2*a* extending from one end of the illuminating plane 2 is taken out through a corner member 6 fitted to the end surface position of the antiskid member 1 as shown in FIG. 5, but without forming such corner member 6, by preliminarily forming a groove for accommodating the cord 2*a* in the baseboard existing, for example, in the lower part of the wall, when the cord 2*a* is inserted into this groove, the cord is not visible from outside, and it is preferable for appearance (so that the foot may not be caught by).

According to the stairs antiskid member of the above embodiment (see FIG. 1 through FIG. 5), since the light transmitting portions 11, 12 in the front and rear side edges emit light, when descending the stairs, two beams of light radiated from the light transmitting portions 11, 12 in the front and rear side edges of the antiskid member 1 can be visually recognized, and in particular, the light can be recognized very well from the rear edge (front side), urging to step at the rear side of the illuminated position, so that the safety may be assured. When ascending the stairs, first, the front edge (front side) looks bright, telling the presence of the outer end A of the tread surface, thereby urging to step at the rear side thereof to assure safety. By the two beams of light gradually appearing at the front side and inner side, a further safety can be assured.

Moreover, the light from the illuminating plane 2 is designed to be radiated from the light transmitting portions 11, 12 through the reflecting portion (see reflecting member 3), different from the prior art, not radiated directly, and the light can be radiated in a state by softening the light from the illuminating plane 2, so that it is effective to enhance the appearance.

Besides, this antiskid member 1 has a three-layer structure accommodating and holding the illuminating plane 2 in its inside, and forming the reflecting member 3 at the luminous side of the illuminating plane 2, and therefore if the thickness of the reflecting member 3 is relatively set large, the overall thickness of the antiskid member 1 can be suppressed as much as possible. Yet, since the thickness of the reflecting member 3 can be set relatively large, the internal loss of light is small, and an excellent emission of light is expected.

In the embodiment, moreover, the illuminating plane 2 which is initially imagined to have the luminous surface directed to the illuminating direction (upper surface) is actually accommodated and held in reverse direction (to emit light toward the lower surface side), and therefore if the thickness of the reflecting member 3 is set relatively large, the thickness of the antiskid member 1 can be suppressed as much as possible. In the dimensions of the presented example, if the thickness of the antiskid member 1 (bulge from the outer end) is about 3 mm, the reflecting member 3 may be set about 2 mm. Since the reflecting member 3 can be set relatively thick, the internal loss of light is small, and an excellent emission of light is expected.

Still more, since the reflecting member 3 is composed of a light permeable material and is set in a light guide layer for guiding the light, the light from the illuminating plane 2 is radiated from the light transmitting portions 11, 12 while repeating deflection and reflection by the reflecting member 3, and the light can be guided into a position remote from the luminous portion of the illuminating plane 2, in a state decreased in the internal loss, so that an excellent luminous state can be obtained. Besides, a reflecting surface 3*a* for directing the light from the illuminating plane 2 to the side of the light transmitting portions 11, 12 is formed, and a further excellent luminous state may be achieved.

Figure 6:
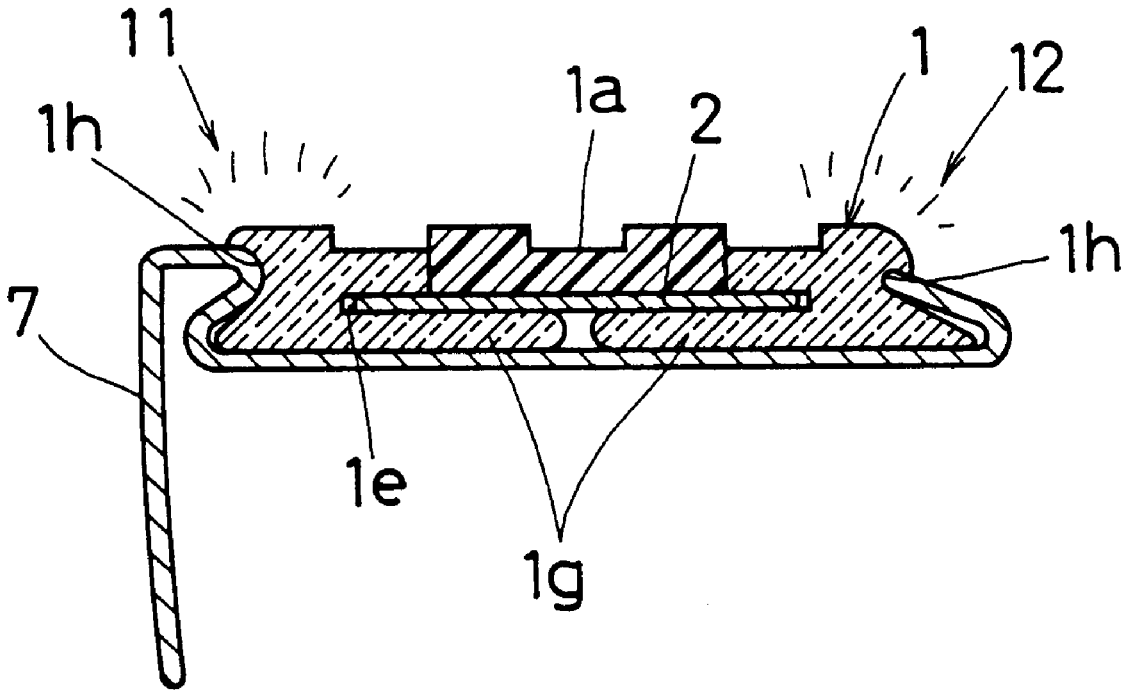
FIG. 6 is a sectional view showing other embodiment of stairs antiskid member of the invention.

FIG. 6 shows other embodiment of the stairs antiskid member, and this embodiment is suited to stairs composed of concrete or iron, whether outdoors or indoors. This antiskid member 1 is formed by simultaneous extrusion of a soft light permeable synthetic resin of transparent, translucent or milky white material, and a colored soft synthetic resin. The colored resin forms part of the middle portion, and the front edge and rear edge of this part are set in light transmitting portions 11, 12. The middle portion may be transparent, but a proper colored resin is used for enhancing the appearance. The entire upper surface is the stopping portion 1*a*.

From both side edges before and after the antiskid member 1 toward the lower part, a reflecting portion 1*g* is extended integrally in a pi-form across a gap (accommodating portion 1*e*) for accommodating the illuminating plane 2. That is, in this antiskid member 1, the reflecting portion 1*g* is formed integrally. Between mutually confronting reflecting portions 1*g*, a gap of a proper width is formed, and the accommodating work convenience of the illuminating plane 2 is enhanced.

Thus composed antiskid member 1 in FIG. 6 is attached to the tread surface through a mounting member 7 of stainless steel or other metal. Accordingly, at both ends before and after the antiskid member 1, engaging portions 1*h* to be engaged with the mounting member 7 are formed. The mounting member 7 is preferred to be made of stainless steel. This is because, the light entering the reflecting portion 1*g* from the illuminating plane 2 is reflected favorable owing to the metallic gloss of the stainless steel, without having to form the reflecting surface 3*a* in the reflecting portion 1*g* by the notch as in the preceding embodiment, and is radiated from the light transmitting portions 11, 12 at front and rear both side edges. Of course, the reflecting surface 3*a* may be also formed.

Herein, the mounting member 7 is fixed by screws or concrete nails by forming holes at proper positions, or in the case of steel structure, it may be fixed by adhesive or the like.

In this constitution, too, the same action and effect as in the preceding embodiment are obtained, and in FIG. 6 the same parts as in the foregoing drawings are identified with same reference numerals, and detailed descriptions are omitted.

In the invention, the reflecting portion corresponds to the reflecting member 3 and reflecting portion 1*g* in the individual embodiments.

What is claimed is:

1. A stairs antiskid member to be fixed to an outer end of stairs, wherein an illuminating plane parallel to the tread surface of the stairs in a state with its luminous surface directed downward is accommodated and held in the antiskid member, an opaque stopping portion made of soft synthetic resin is formed in the middle portion of the upper surface of the antiskid member, a permeable light transmitting portion is formed at both side edges before and after across the stopping portion, a reflecting portion having a proper thickness made of light permeable soft synthetic resin is provided at the lower side of the illuminating plane, and a reflecting plane for directing the light from the illuminating plane to the light transmitting portion side is formed in the reflecting portion.

2. The member of claim 1, wherein the permeable light transmitting portion is formed in both front and rear side edges.

3. The member of claim 1, wherein the reflecting portion is set in a light guide layer for guiding the light.

4. A stairs covering comprising:

an anti-skid layer disposed on a top surface of a stair;

an illuminating plate disposed on top of said anti-skid layer;

means for reflecting upward from said anti-skid layer light from said illuminating means;

a light transmitting layer disposed above said illuminating plate for transmitting at least a reflected light; and an opague stepping surface disposed on a portion of top of said light transmitting layer; whereby light is visible through said light transmitting layer not covered by said stepping surface.

5. The covering of claim 4, wherein said stepping surface is disposed at a middle area of said transmitting layer so that at a front and rear portion thereof areas are left uncovered to allow light to be visible to the user of the stairs.

6. The covering of claim 4, wherein said means for reflecting comprises a light permeable means set in a light guide layer.

7. The covering, of claim 4, wherein said means for reflecting comprises a reflecting plane.

* * * * *